United States Patent [19]

Jenne' et al.

[11] 3,964,402

[45] June 22, 1976

[54] PORTABLE STAGE

[75] Inventors: James F. Jenne'; Irvin E. Dorschner, both of Owatonna; Harvey M. Urch, West Concord; Jerry A. Wenger, Owatonna, all of Minn.

[73] Assignee: Wenger Corporation, Owatonna, Minn.

[22] Filed: May 1, 1974

[21] Appl. No.: 465,925

[52] U.S. Cl. ..... 108/64; 52/584; 52/754; 108/114; 312/111; 403/330

[51] Int. Cl.[2] ..... F16B 1/00

[58] Field of Search ..... 52/584, 758 C, 753 C, 52/754, 578, 580, 581; 108/64, 114; 312/107, 111; 403/321, 330

[56] References Cited

UNITED STATES PATENTS

| | | | |
|---|---|---|---|
| 2,392,551 | 1/1946 | Roe | 52/586 |
| 2,403,338 | 7/1946 | Butler | 108/64 |
| 2,423,695 | 7/1947 | Falco | 52/753 C X |
| 2,836,475 | 5/1958 | Sapp | 108/64 |
| 3,563,624 | 2/1971 | Stice | 312/107 X |
| 3,574,449 | 4/1971 | Rosenberg | 52/584 X |

*Primary Examiner*—Roy D. Frazier
*Assistant Examiner*—William E. Lyddane
*Attorney, Agent, or Firm*—Wegner, Stellman, McCord, Wiles & Wood

[57] ABSTRACT

A portable stage having plural separable stage units with means for holding adjacent stage units in fixed relation and at the same or different heights, including a pair of elongate grooved members associated one with each stage unit and with clamp mechanism positionable within the grooves of both of said members for imparting rigidity to the adjacent stage units and for holding said stage units locked to each other.

10 Claims, 9 Drawing Figures

Fig. 5.
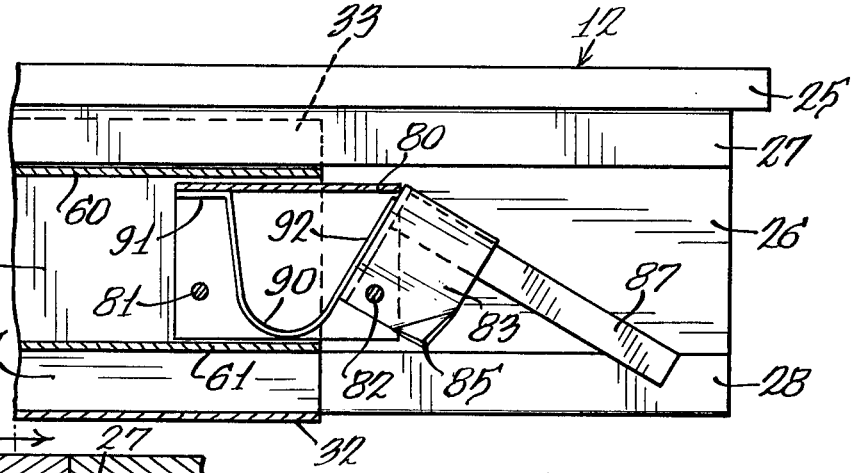
Fig. 6.
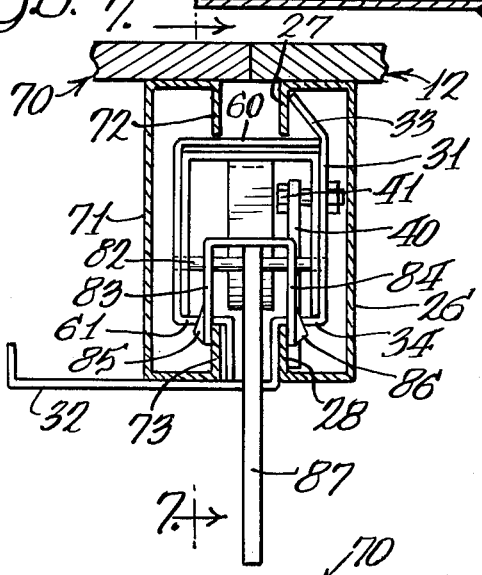
Fig. 8.
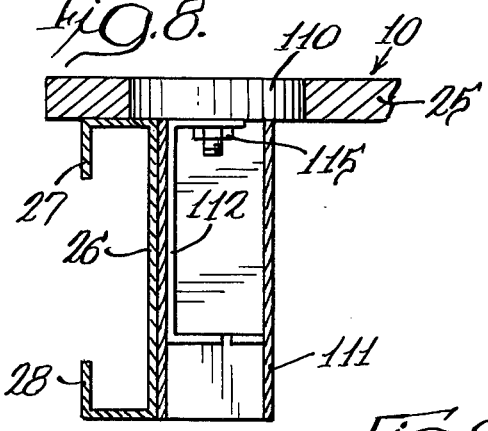
Fig. 9.
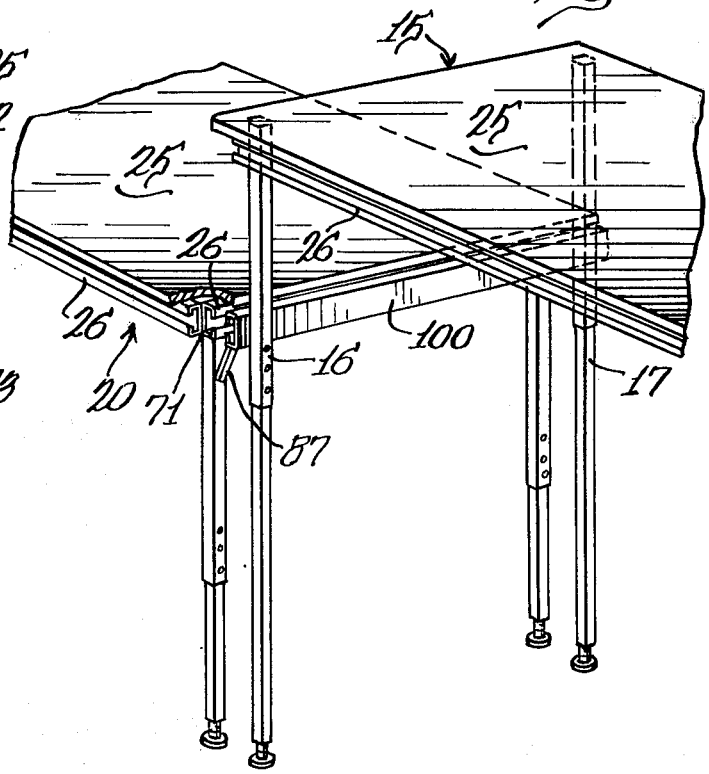
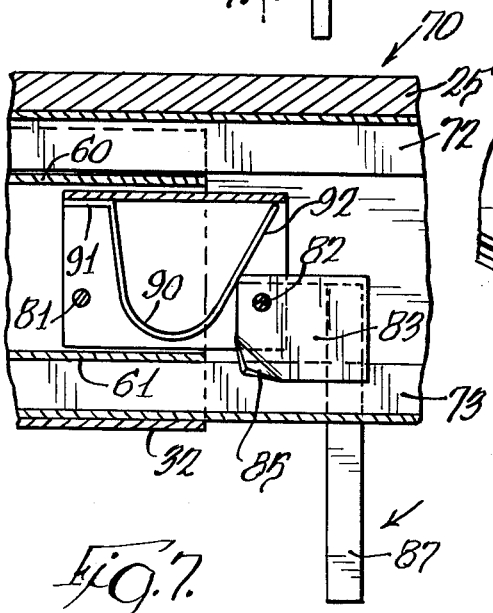
Fig. 7.

PORTABLE STAGE

BACKGROUND OF THE INVENTION

This invention pertains to portable stage systems and, more particularly, to such a system having a plurality of separable stage units which can have their top surfaces positioned at the same of different heights and with easily operated structure for holding the stage units in desired assembled relation.

In portable stage systems, it is known to have a plurality of separable stage units with each unit having a perimetral frame to provide strength and to support a top surface panel for the stage unit. Such structures have included a clamp for engagement with adjacent frame members to hold the stage units locked to each other. Such clamp structure has not been constructed to impart additional rigidity to the perimetral frame members and, at the same time, include a clamp member which can be pivoted into engagement with parts of the frame member associated with adjacent stage units to hold the stage units locked to each other.

SUMMARY

A primary feature of the invention disclosed herein is to provide a portable stage system having a coacting clamp mechanism and perimetral frame structure for a stage unit whereby a tongue and groove locking effect is obtained between adjacent stage units to firmly lock adjacent perimetral frame members together and have them both act as a single beam under vertical loading imposed on the surface of the portable stage.

More particularly, each stage unit has a perimetral frame formed from elongate grooved members whereby a pair of stage units have their adjacent sections of perimetral frames brought closely together and a clamp mechanism includes a rectangular housing positionable within the grooves of the frame members to provide a tongue and groove joint and wherein the clamp mechanism additionally includes a manually operable clamp member that can be moved into clamping position to firmly draw the adjacent frame members toward each other to securely lock the stage units together.

The clamp mechanism has an elongate mounting plate which is releasably attachable to a perimetral frame member of a stage unit for retention therewith and with structure associated therewith providing a pair of generally rectangular housings positionable within perimetral frame members of a pair of stage units to provide vertical rigidity to the assembled stage units and which additionally has the manually operable clamp members for movement to a clamping position to coact with a pair of flanges on the perimetral frame members for drawing the frame members together and holding them in clamped relation.

With the invention embodied herein, it is possible to interlock two stage units at different heights as established by setting of the adjustable length legs of a stage unit and with an elongate grooved member secured to a pair of legs of the taller stage unit to coact with a clamp mechanism for attachment to the perimetral frame member of the stage unit of a lower height.

BRIEF DESCRIPTION OF THE DRAWINGS

FIG. 5 is a vertical section taken generally along the line 5—5 in FIG. 4, with the clamp member in non-clamping position;

FIG. 6 is a vertical section on an enlarged scale, taken generally along the line 6—6 in FIG. 1;

FIG. 7 is a vertical section, taken generally along the line 7—7 in FIG. 6;

FIG. 8 is a vertical section, on an enlarged scale taken generally along the line 8—8 in FIG. 1; and FIG. 9 is a fragmentary perspective view showing fragmentary parts of a pair of stage units of different height in assembled relation.

DESCRIPTION OF THE PREFERRED EMBODIMENT

Figure 1:
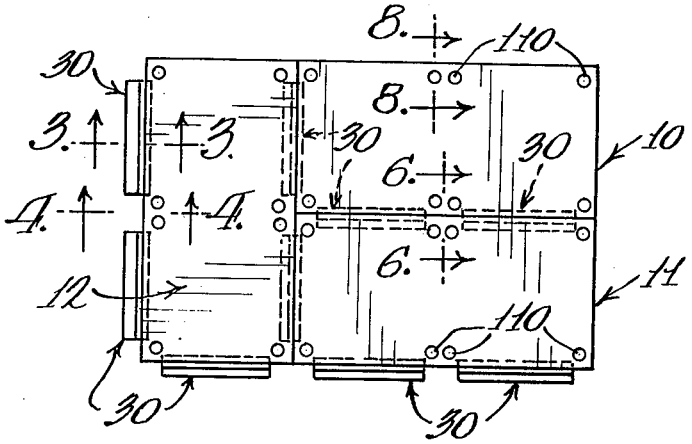
FIG. 1 is a plan view showing a plurality of stage units arranged in a particular relation for establishing a part of a portable stage.

A portable stage is shown in plan view in FIG. 1 wherein a plurality of separable stage units 10, 11 and 12 are secured together to provide a portion of a smooth-surfaced, portable stage. As shown in FIG. 1, these stage units are generally rectangular. However, the stage units may be provided in other shapes additional to rectangular. Each of the stage units has a plurality of pivotably retractable floor-engaging adjustable length legs. As shown in FIG. 9, a stage unit 15 has a pair of legs 16 and 17 extending from two corners thereof, with additional adjustable length legs at the remaining corners of the stage unit. With the adjustable length legs, the extension thereof for the stage unit 15 can be greater than for a stage unit 20, shown in FIG. 9, whereby the stage units 15 and 20 may be disposed at different heights.

The structure for easily and quickly securing a plurality of stage units together at desired height includes a component of the stage unit in combination with clamp mechanism particularly designed for coaction with the structure of the stage unit. The stage unit 12, shown particularly in FIGS. 3 and 4, has a continuous perimetral frame which lies beneath a planar surface member 25 of the stage unit and is slightly set in from the external perimeter thereof. This perimetral frame is formed from a series of lengths of an elongate grooved member 26 which are suitably secured together at the four corners of a stage unit, as by welding, and with the elongate grooved member being generally C-shaped to have a pair of inturned flanges 27 and 28. This perimetral frame extends about the four sides of the rectangular stage unit whereby there is attachment capability at all four sides of the stage unit.

Figure 2:
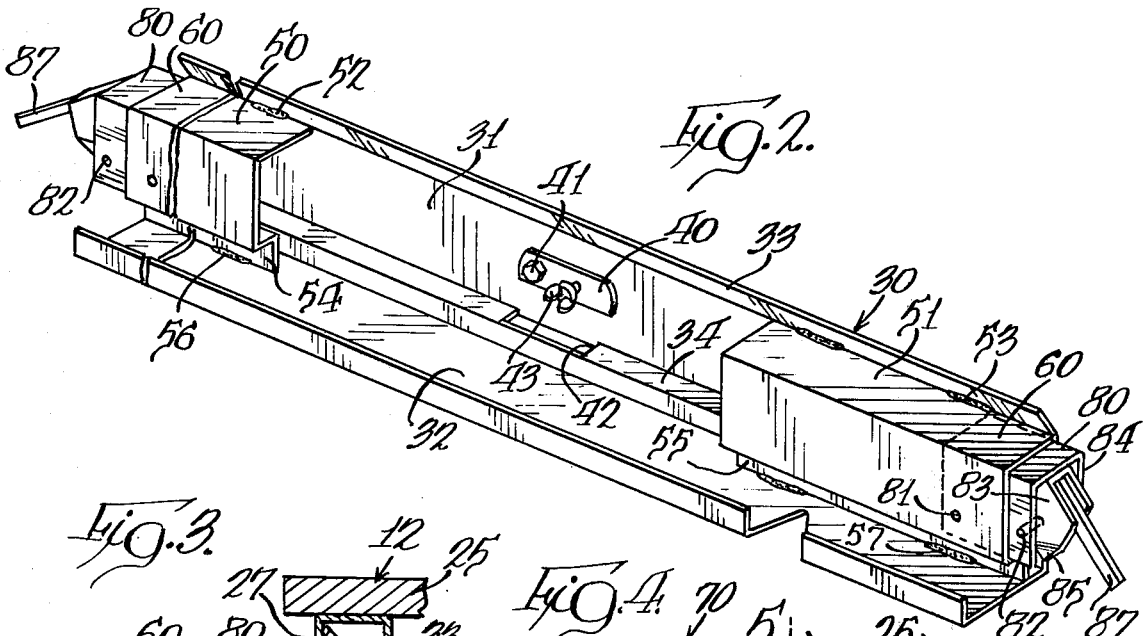
FIG. 2 is a perspective view of a clamp mechanism as used in assembling the stage units of FIG. 1 and on an enlarged scale.
Figure 3:
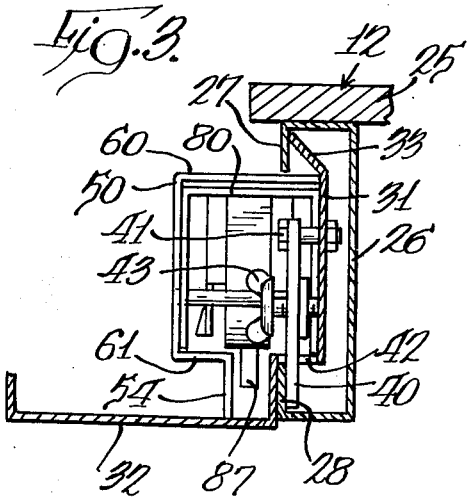
FIG. 3 is a vertical section on an enlarged scale taken generally along the line 3—3 in FIG. 1.

The clamp mechanism for securing adjacent stage units is indicated generally at 30 in FIG. 2 and includes an elongate mounting plate of a general L-shape to have a vertical panel 31 and a horizontally-extending panel 32. The vertical panel 31 has an upper flange 33 extending at a slight angle therefrom and a lower offset portion 34 extending to the horizontal panel 32 whereby the clamp mechanism may be assembled with a perimetral frame member 26 in the manner shown in FIG. 3. The clamp mechanism is positioned within the groove of the frame member 26 with the upper flange 33 engaged behind the upper inturned flange 27 and with the offset part 34 resting on the lower inturned flange 28. The clamp mechanism is removably attached to the elongate frame member 26 by means of a tab pivotally mounted to the vertical panel 31 by a pivot bolt 41 and pivoted downwardly to a vertical position through a slot 42 to extend vertically, as shown in FIG. 3. In the vertical position, a wing nut 43 threaded into the tab is rotated to react against the vertical panel 31 and force the tab 40 in a clockwise direction as viewed in FIG. 3, to have the tab 40 force parts of the clamp mechanism against the inturned flanges 27 and 28. This pivoting action is permitted by a relatively loose mounting of the tab 40 on the pivot bolt 41.

The clamp mechanism has a pair of generally rectangular housings at opposite ends thereof provided by a pair of shaped plates 50 and 51 having a planar upper part 60 secured at an edge to the vertical panel 31 of the mounting plate by spaced welds 52 and 53, respectively, and with lower vertical sections 54 and 55, respectively, secured to the horizontal panel 32, as by welds 56 and 57. The shaped plates 50 and 51 define a pair of spaced, parallel surfaces 60 and 61 which function, in part, as the tongue structure for the tongue and groove action in securing the stage units together.

Figure 4:
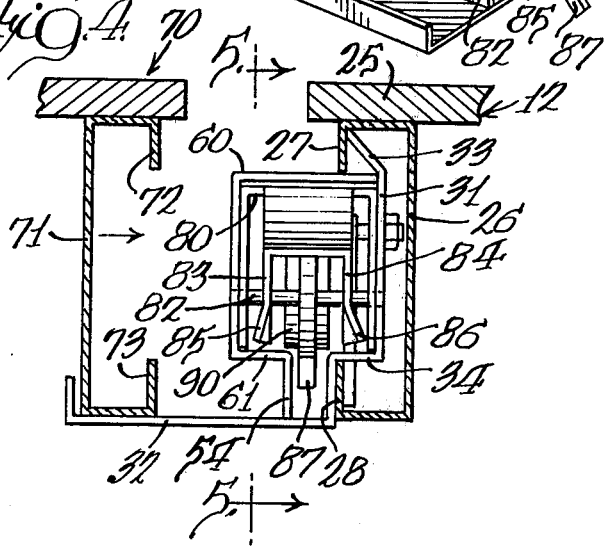
FIG. 4 is a vertical section taken generally along the line 4—4 in FIG. 1, on an enlarged scale, and showing a fragmentary part of another stage unit initially positioned for attachment to a stage unit shown in FIG. 1.

With a clamp mechanism 30 mounted as shown in FIG. 3 to a frame member 26, the initial association of an additional stage unit with the stage unit 12 is shown in FIG. 4 wherein a stage unit 70 has its elongate grooved frame member 71 is initially guided into position by engagement with the horizontal panel 32 of the mounting plate of the clamp mechanism. Frame member 71 is then advanced toward the right, as viewed in FIG. 4, to the position shown in FIG. 6. In the latter position, the frame member 71 has its upper inturned flange 72 closely overlying the horizontal panel 60 of the rectangular housings and has its lower inturned flange 73 extended upwardly substantially into engagement with the lower horizontal portions 61 of the housing. This relatively close fit along with the pre-established engagement between the frame member 26 of the stage unit 12 with the rectangular housings of the clamp mechanism provides a tongue and groove lock whereby adjacent frame members of two stage units are effectively secured together as a single beam for rigidifying thereof and for avoiding any independent deflection of one stage unit relative to another under vertical load.

Each clamp mechanism 30 has a pair of manually-operable clamp members extending outwardly at opposite ends thereof, with each clamp member having the same construction and one clamp member being described in detail. A mounting bracket 80 of a downwardly-open U-shape is pinned to the housing 51 by a pin 81 and disposed interiorly thereof with an end extending outwardly of the housing. A clamp member is pivoted to the housing by a pivot pin 82 and embodies a downwardly-open U-shaped member with a pair of legs 83 and 84 having inclined cam surfaces 85 and 86, respectively, at the lower edges thereof. A handle 87 extends outwardly from a fixed connection to the clamp member for rotatably positioning the clamp member. A leaf spring 90 has an end 91 secured to the interior of the mounting member 80 and a section 92 coacting with the clamp member to hold it either in the nonclamping position, shown in FIG. 5, or the clamping position shown in FIG. 7.

With the adjacent stage units 12 and 70 brought together as shown in FIG. 6, the clamp member is initially in the position shown in FIG. 5. The adjacent elongate groove members 26 and 71 are then drawn toward each other by a clockwise pivoting of the clamp member from the position of FIG. 5 to the clamping position of FIG. 7. The cam surfaces 85 and 86 on the legs permit an engaging action of the inturned flanges 28 and 73 of the elongate groove members, followed by drawing together of these flanges.

A clamp mechanism 30 has a length somewhat less than the length of the shorter dimension of a stage unit. As an example, if a rectangular stage unit has a dimension of 4 x 8 feet, then a single clamp mechanism 30 is mounted along the shorter dimension of the stage unit with two of the clamp mechanisms being located along the longer dimension of the stage unit.

As shown in FIG. 1, the stage units 10 and 11 have been secured together by a pair of clamp mechanisms 30 with the stage unit 12 being secured to stage unit 11 by an additional pair of clamp mechanisms 30. The stage units 11 and 12 of FIG. 1 are shown with additional clamp mechanisms 30 positioned outwardly thereof whereby additional stage units may be associated therewith for a portable stage larger than that shown. There is extensive versatility in the number of stage units to be put together and in the potential shape of each stage unit. With the removable attachment capability of the clamp mechanism 30 by use of tab 40, it is only necessary to mount such clamp mechanisms where attachment capability is needed. After a pair of stage unit are brought together to the position of FIG. 6, a person may then reach beneath the stage units to rotate the handles 87 to bring the clamp members from the nonclamping position of FIG. 5 to the clamping position of FIG. 7.

A variation is assembly of the stage units is shown in FIG. 9 wherein the stage units 15 and 20 are at different heights and are held together by use of an elongate grooved member 100 of the same basic shape as the elongate grooved member 26. The member 100 is secured to the legs 16 and 17 by suitable fasteners or by welding for coaction with the perimetral frame member 71 of the stage unit 20. A clamp mechanism 30 is mounted within the elongate grooved member 100 in the same manner as shown in FIG. 4 for the attachment of a clamp mechanism to the frame member 26.

In a portable stage, there often are requirements for passage of electrical conduit from beneath the stage to a location thereabove or for mounting of railings or other support structures on the stage. Structure as shown in FIGS. 1 and 8 is provided to accommodate these functions. The top surface member 25 of the portable stage unit is provided with a series of openings located at the corners thereof and at additional locations along the perimeter each of which is closed by a removable plug 110. These plugs each overlie a short length of square tubular member 111 suitably secured to the adjacent perimetral frame member 26 as by welding and the plug 110 is releasably held in position by a shaped fastener 112 secured to the underside of the plug 110 by a means, such as a screw 115. The fastener is insertable into the tubular member 111 and frictionally retained therein against removal. The plug 110 is of a diameter greater than the cross-section of the tubular member 111 whereby the plug is held level with the top of the surface member 25. When a post of a light stand or of a railing, for example, is to be supported on the portable stage, the plug 110 is removed and the post inserted into the tubular member 111. Such tubular members that are not in use are closed off by the plugs 110 to retain the smooth top surface of the portable stage.

We claim:

1. A portable stage having plural separable stage units and means for holding adjacent stage units in fixed relation including a pair of elongate grooved members attached one to each stage unit and opening outwardly therefrom and with a pair of inturned flanges on each member, a clamp mechanism positioned within the grooves of both of said grooved members and including rigid members between and in engagement with said pairs of flanges to define a tongue and groove connection between units for imparting rigidity to said grooved members and having pivotally mounted means to move behind and engage a flange on each of said grooved members and hold said grooved members locked to each other.

2. A portable stage as defined in claim 1 wherein said clamp mechanism includes a mounting plate, said rigid members of the clamp mechanism comprising a pair of plates associated with said mounting plate at spaced locations to define a pair of hollow rectangular housings which engage between said pair of flanges for said imparting of rigidity, and said pivotally mounted means including a U-shaped member pivotally mounted to one of said housings and with a pair of legs each engageable behind a flange.

3. A portable stage unit as defined in claim 2 wherein said pair of legs each have an inclined cam surface to engage behind said flanges and draw said grooved members toward each other as said U-shaped member is pivoted.

4. A portable stage unit as defined in claim 3 wherein said U-shaped member has a clamping position and a nonclamping position, a spring for holding said U-shaped member in one or the other of said positions, and an operating handle connected to said U-shaped member.

5. A portable stage as defined in claim 1 and having a perimetral frame defined by a plurality of said elongate grooved members, a surface panel mounted on said perimetral frame, a series of tubes secured to said frame interior, openings in said surface panel aligned with said tubes for mounting of structure in said tubes or passage of objects such as conduit therethrough, and a plurality of plug members for closing said openings when not in use.

6. A portable stage having plural stage units for association in a desired relation, adjustable length leg means associated with each unit, manually-operable clamp mechanism for interconnecting adjacent stage units including an elongate body, a pair of housings positioned at each end of said body and a U-shape clamp member with a pair of spaced legs pivotally mounted on each housing, and a pair of C-shape members associated one with each adjacent stage unit and having an outwardly-opening groove for receiving said housings in said grooves and with spaced apart flanges for engagement by said clamp member legs as the clamp member is pivoted.

7. A portable stage having clamp mechanism for attaching adjacent stage units, said clamp mechanism comprising a generally L-shape elongate mounting plate, a pair of plates associated with said mounting plate at spaced locations to define a pair of rectangular housings, a pivotable clamp member pivotally mounted at each housing and including a U-shaped member with a pair of spaced legs, a handle connected to said clamp member, and means for holding said clamp member in either a clamping or nonclamping position.

8. A portable stage as defined in claim 7 wherein said clamp mechanism is removably attachable to a stage unit having an elongate grooved member, including a flange on said mounting plate engageable within the groove of the grooved member, and a locking tab on said mounting plate engageable with said grooved member.

9. A portable stage as defined in claim 7 wherein said holding means for the clamp member includes a leaf spring engageable with the clamp member to exert a force holding the clamp member in either of said positions.

10. A portable stage as defined in claim 7 wherein the legs of said clamp member each have an inclined cam surface at a leading edge thereof to draw a pair of stage units toward each other as the clamp member moves to clamping position.

* * * * *